US007721482B1

(12) United States Patent
Swan

(10) Patent No.: US 7,721,482 B1
(45) Date of Patent: May 25, 2010

(54) FOLDING FRONT SIGHT

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 0 days.

(21) Appl. No.: 12/361,593

(22) Filed: Jan. 29, 2009

Related U.S. Application Data

(60) Provisional application No. 61/025,365, filed on Feb. 1, 2008.

(51) Int. Cl.
*F41G 1/02* (2006.01)

(52) U.S. Cl. ..... 42/148

(58) Field of Classification Search ..... 42/140, 42/141, 148
See application file for complete search history.

(56) References Cited

U.S. PATENT DOCUMENTS

| | | | | |
|---|---|---|---|---|
| 358,747 | A * | 3/1887 | Orr | 42/138 |
| 621,066 | A | 3/1899 | Gilbert-Russell | |
| 861,652 | A | 7/1907 | Hawkins | |
| 878,857 | A | 2/1908 | Bevier | |
| 4,597,211 | A * | 7/1986 | Miles | 42/112 |
| 4,766,800 | A | 8/1988 | Miller et al. | |
| 5,533,292 | A | 7/1996 | Swan | |
| 6,732,467 | B1 | 5/2004 | Luth | |
| D526,380 | S | 8/2006 | Swan | |
| 7,181,882 | B2 | 2/2007 | Woodbury | |
| 7,356,962 | B2 | 4/2008 | Swan | |
| 2007/0006513 | A1 | 1/2007 | Snyder et al. | |

FOREIGN PATENT DOCUMENTS

| | | |
|---|---|---|
| CH | 666544 | 7/1988 |
| WO | 2006138106 A2 | 12/2006 |

OTHER PUBLICATIONS

"A.R.M.S. Silhouette #41-B-Folding Front Sight Barrel Mounted", http:///www.operationparts.com/A_R_M_S_SILHOUETTE_41_B_Folding_Front_Sight_p/41-b.htm.

* cited by examiner

*Primary Examiner*—Stephen M Johnson
(74) *Attorney, Agent, or Firm*—Barlow, Josephs & Holms, Ltd.

(57) ABSTRACT

A folding front sight for a firearm is disclosed. The folding front sight includes a base with a forward end and a rearward end. A forward sight frame at the forward end of the base is included. The forward sight frame includes a front sight post at an upper end thereof, and is movable between an upright deployed position and a stowed position. A support member has a rear end extending from the rearward end of the base and a forward end engaged with the upper end of the forward sight frame to support the forward sight frame, when the forward sight frame is in the deployed position. The base, the forward sight frame and the support member cooperate to define a triangular silhouette when the forward sight frame is in the deployed position.

23 Claims, 12 Drawing Sheets

FOLDING FRONT SIGHT

CROSS-REFERENCE TO RELATED APPLICATION

The present patent document claims priority to earlier filed U.S. Provisional Patent Application Ser. No. 61/025,365, filed Feb. 1, 2008, the entire contents of which are incorporated herein by references.

BACKGROUND OF THE INVENTION

1. Field of the Invention

The present invention relates generally to firearms and more specifically to a collapsible front sight for rifles and carbines.

2. Background of the Related Art

Referring now to FIG. 1, for 40 years, the current standard front sight 10 attached to a barrel 12 of the AR-15, M4, and M-16 family of weapons includes a triangle-shaped profile, which is readily identifiable throughout the world. This well thought out and combat proven design includes a rear angled support 14 for greater strength, which gives the front sight 10 its distinct triangle silhouette. The angled support feature also helps deflects branches, wires, and other combat hazards that could get a weapon hung up at the worst of times.

However, when enhanced optical sighting systems, such as scopes, are used, the infantryman does not need the front sight and often finds it to interfere with his aiming. Consequently, infantrymen use front sights that fold or collapse or they remove the front sight entirely from the weapon. However, using a prior art folding sight or removing the sight from the weapon necessarily changes the appearance of the weapon. In the case of special operations personnel, having a non-standard looking weapon can compromise the identity of the operative, which in turn can compromise operational security. Accordingly it would be desirable to have a folding front sight that more closely resembles a standard front sight in order to preserve the anonymity of the special operations operative.

SUMMARY OF THE INVENTION

The folding front sight of the present invention solves the problems of the prior art by providing a front sight with a base with a forward end and a rearward end. A forward sight frame at the forward end of the base is included. The forward sight frame includes a front sight post at an upper end thereof, and is movable between an upright deployed position and a stowed position. A support member has a rear end extending from the rearward end of the base and a forward end engaged with the upper end of the forward sight frame to support the forward sight frame, when the forward sight frame is in the deployed position. The base, the forward sight frame and the support member cooperate to define a triangular silhouette when the forward sight frame is in the deployed position.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENTS

Figure 1:
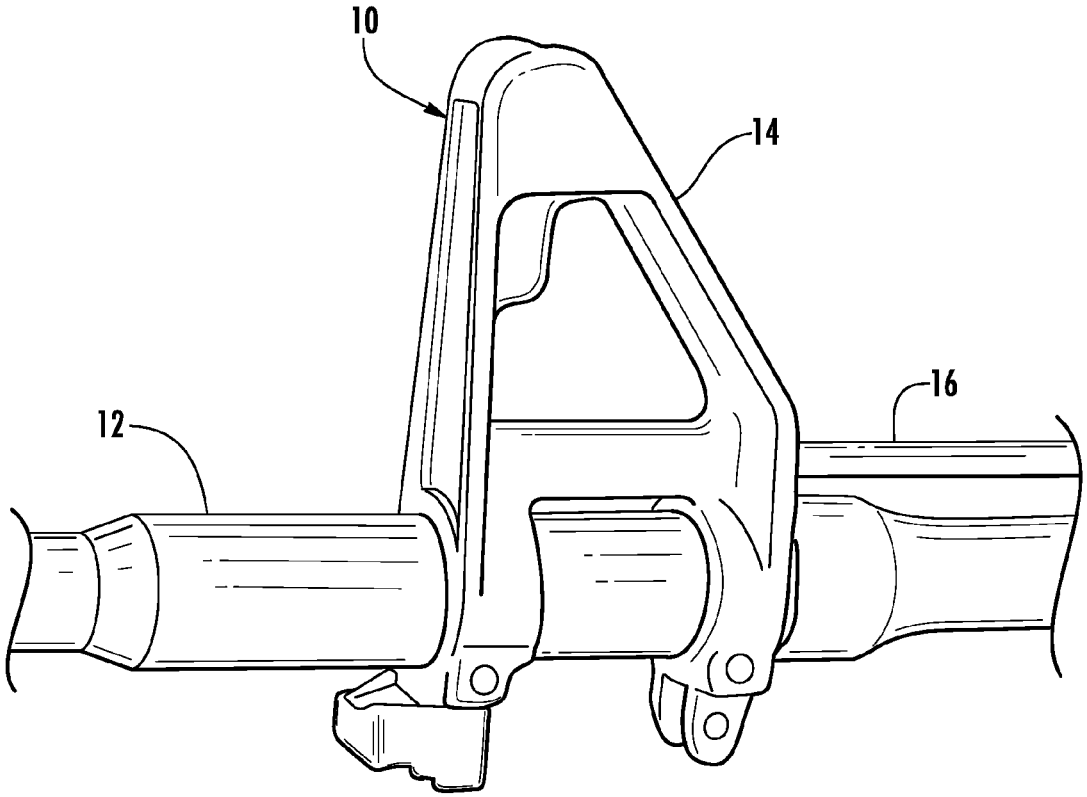
FIG. 1 is a perspective view of a prior art non-folding front sight.
Figure 2A:
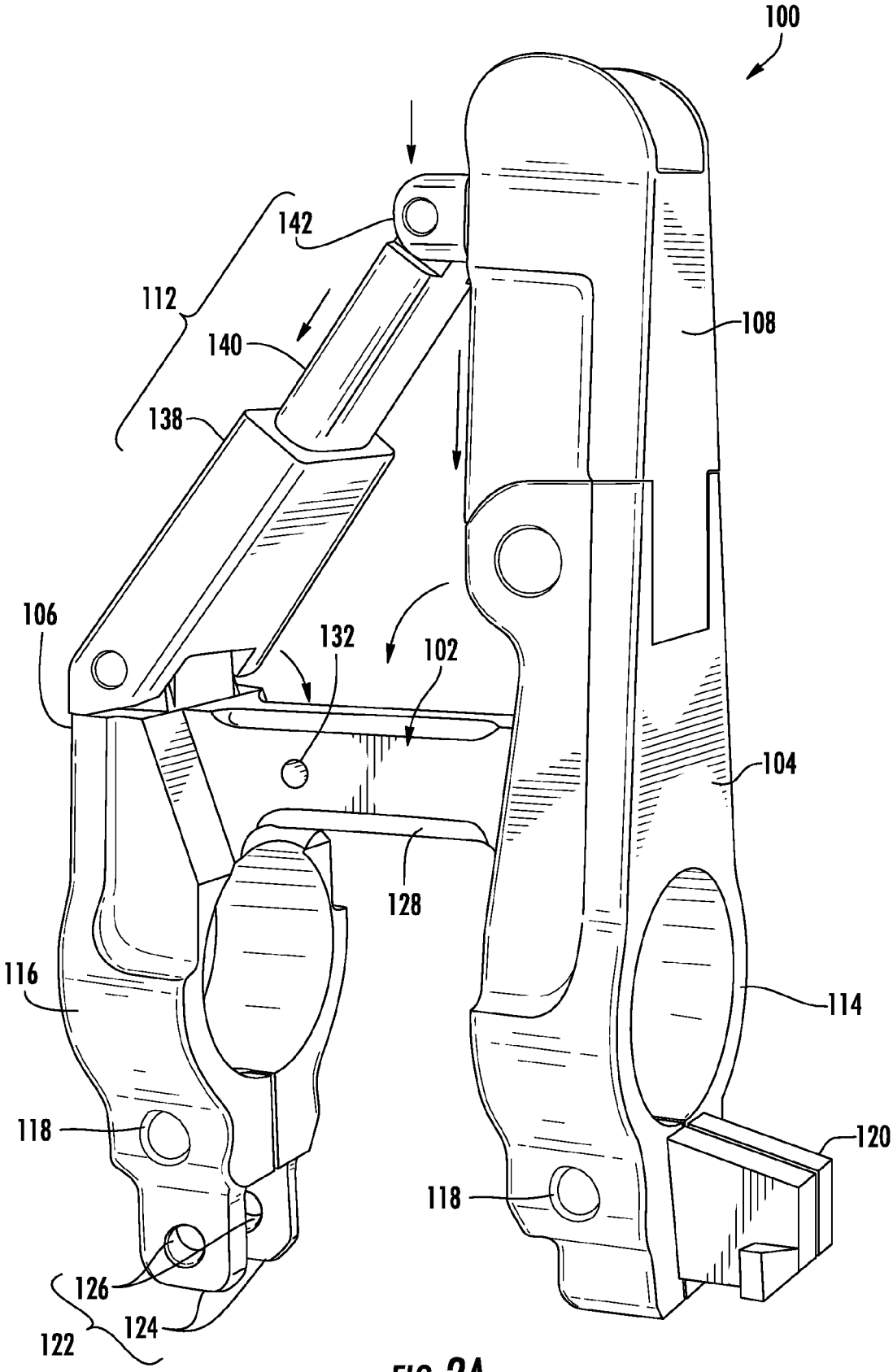
FIG. 2A is front perspective view of an embodiment of the folding front sight of the present invention.
Figure 2B:
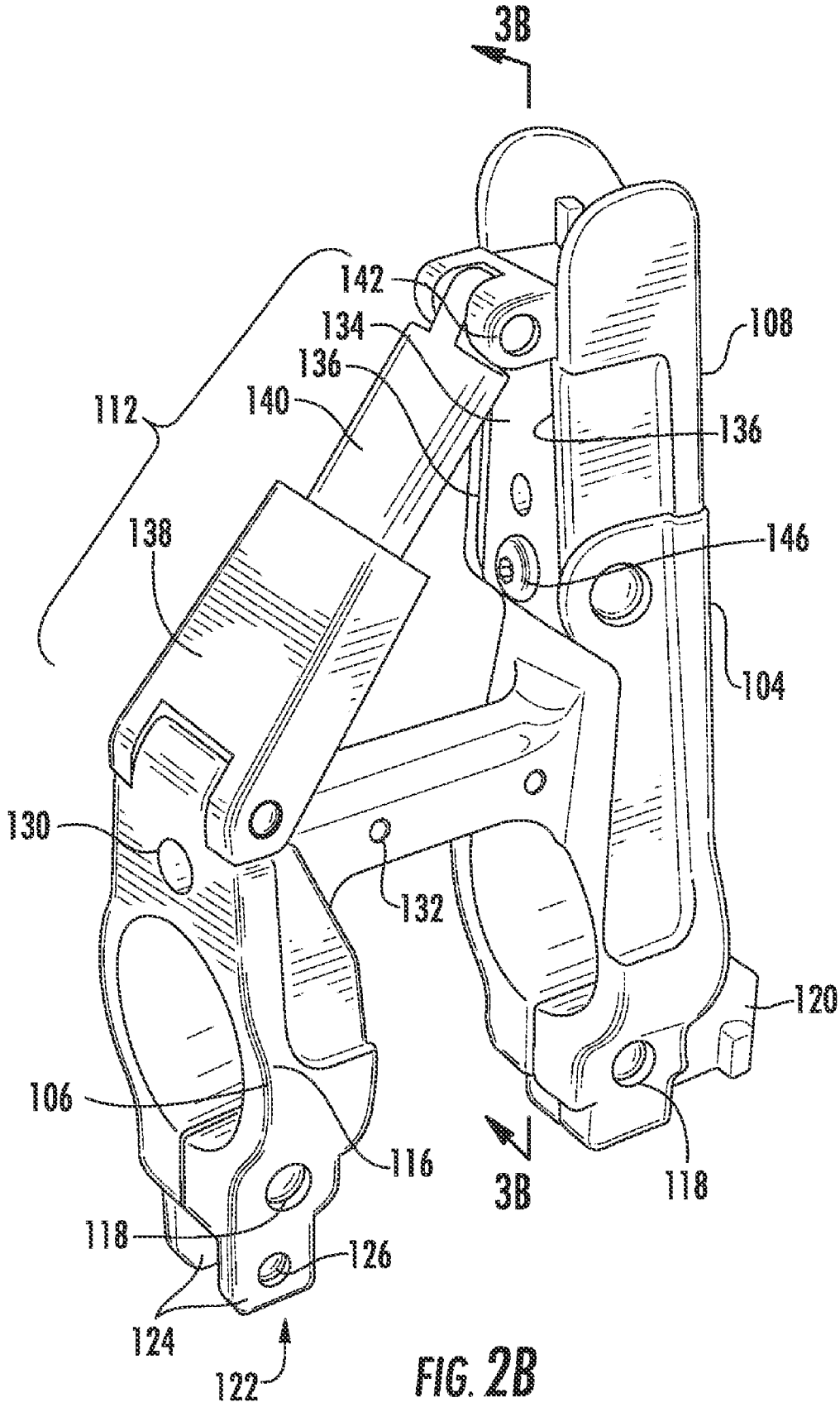
FIG. 2B is rear perspective view thereof.

Referring now to FIGS. 2-8, the folding front sight of the present invention is shown generally at 100. The folding front sight 100 includes a base 102 having a front portion 104 and a rear portion 106; a forward sight frame 108 having a front sight post 110 is pivotally attached to the front portion 104 of the base 102. Extending from the rear portion 106 is an extendable slide arm assembly 112, which is connected to the rear portion 106 of the base 102 and the forward sight frame 108, which will be further described below.

Figure 8:
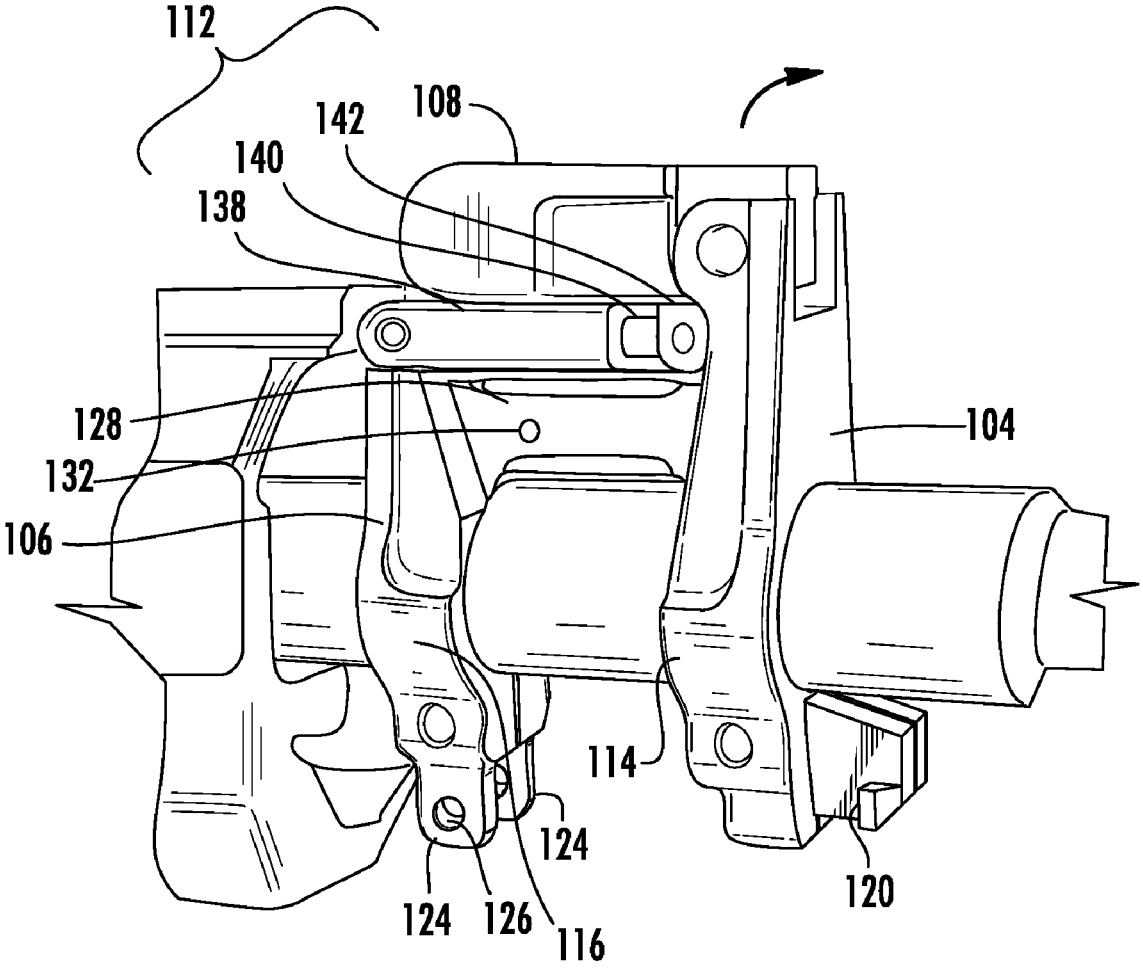
FIG. 8 is a perspective view showing the folding front side mounted to a barrel of a rifle and stowed in its folded state.

The front and rear portions 104, 106 of the base 102 include a pair of clamps 114, 116 configured to secure about a barrel of a weapon, such as an M-16 or AR-15 rifle or carbine as shown in FIG. 8. Threaded apertures 118 are provided near the bottom of the front and rear portions 104,106 to receive screws (not shown) used to tighten and retain the clamps 114, 116 on the barrel of the firearm.

Optionally, a bayonet lug 120 may be formed to the front face of the forward most clamp 114. The bayonet lug 120 configured to receive and retain a bayonet, such as a standard USGI M7 Bayonet, to the barrel of the weapon.

Optionally, a sling swivel mounting structure 122 may depend below the rearward most clamp. The sling swivel mounting structure 122 is configured for attaching a sling swivel and sling (not shown) thereto. Specifically, the sling swivel mounting structure 122 includes a pair of tabs 124. Each tab has a hole 126 formed therethrough. A sling swivel may be secured to the sling swivel mounting structure 122 by pinning it through the holes 126 on the tabs 124 as is known in the prior art.

Connecting the front and rear portions 104, 106 of the base 102 together is a center member 128. A gas tube fitting 130 is formed through the rear portion 106 of the base 102 and into the center member 128. The gas tube fitting 130 is configured to receive a gas tube (best seen in FIG. 1 at 16) for gas-operated automatic and semi-automatic weapons. The gas tube is retained in the gas tube fitting 130 by a pin (not shown) inserted through an aperture 132 formed on the center member 128 and into the gas tube fitting 130. Another aperture 131 is formed through the clamp 116 on the rear portion 106 and is in communication with the gas tube fitting 130. When placed on a firearm, the aperture on the clamp 116 is aligned with an aperture on the barrel in order to make the gas-operation reloading of the firearm function.

Extending upwardly from the front portion 104 of the base 102 is the forward sight frame 108. The forward sight frame 108 includes a sight with a height adjustable front sight post 110. The forward sight frame 108 is pivotally connected to the front portion 104 of the base 102 and configured to fold rearward towards the rear portion 106 of the base 102. The forward sight frame 108 includes a back surface having slot 134 with a pair of raised lips 136 that forms a track, best seen in FIGS. 2A and 6.

Figure 3A:
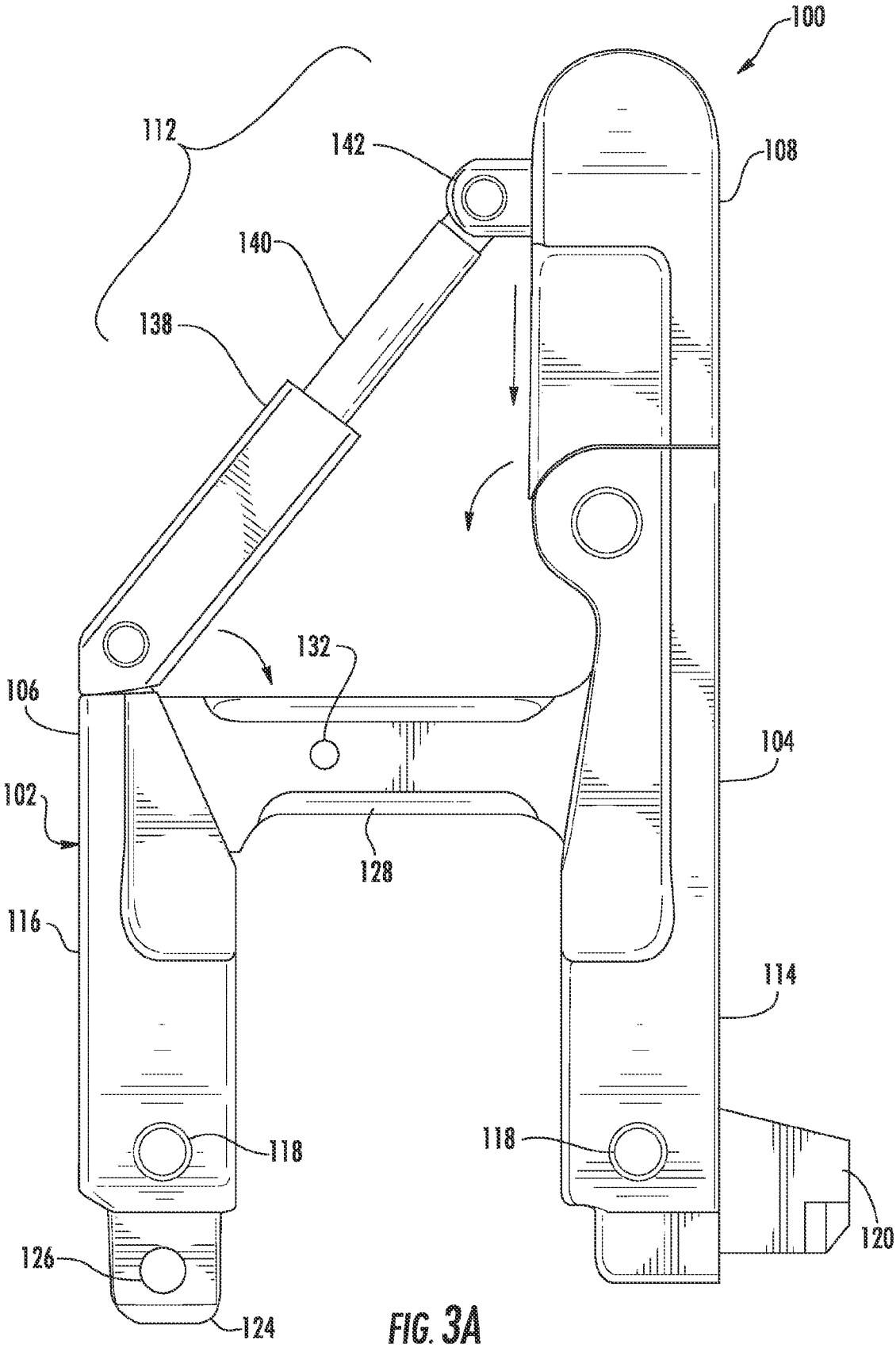
FIG. 3A is a right side view thereof.
Figure 3B:
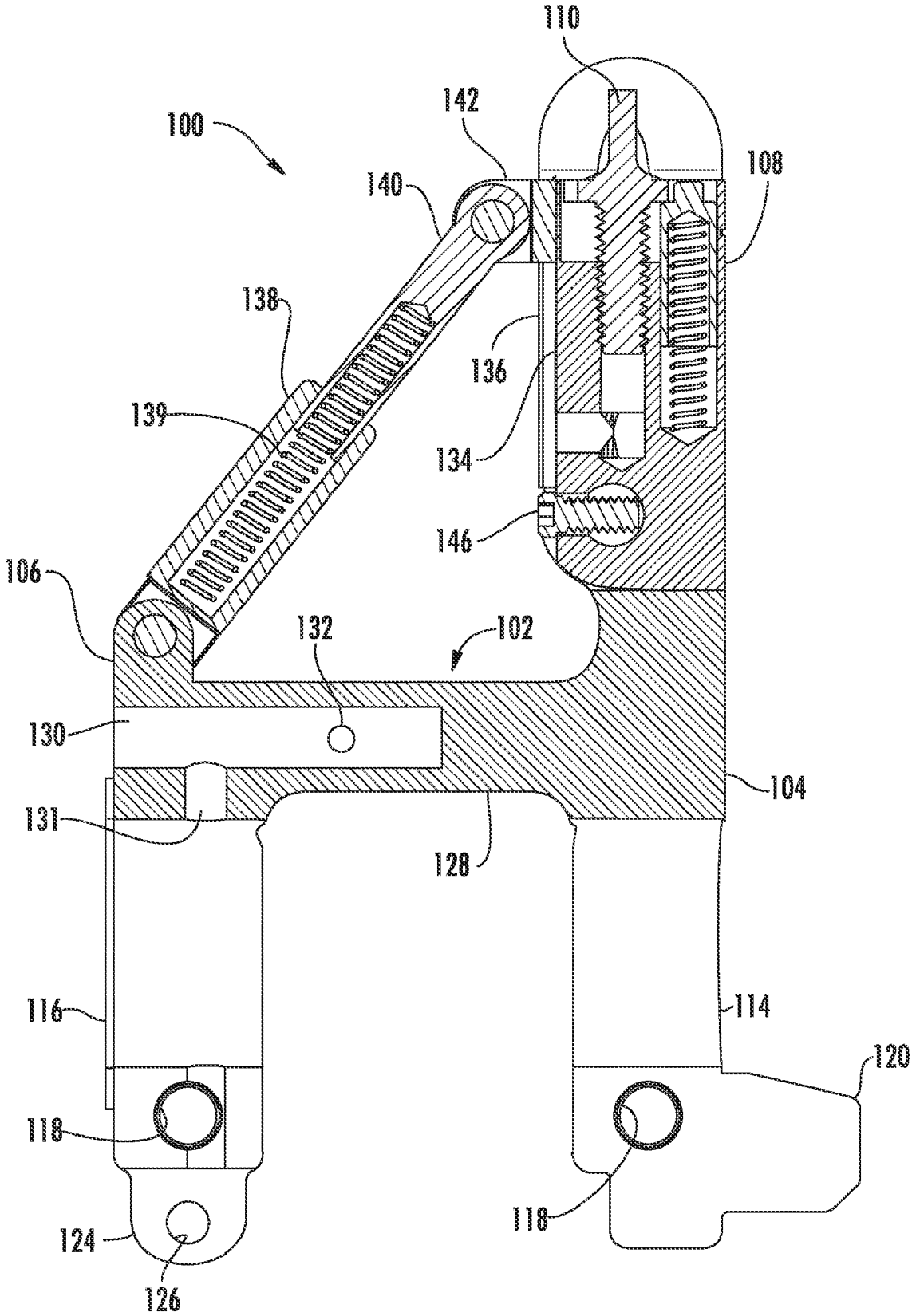
FIG. 3B is a side cross-section view through line 3B-3B of FIG. 2B.
Figure 4:
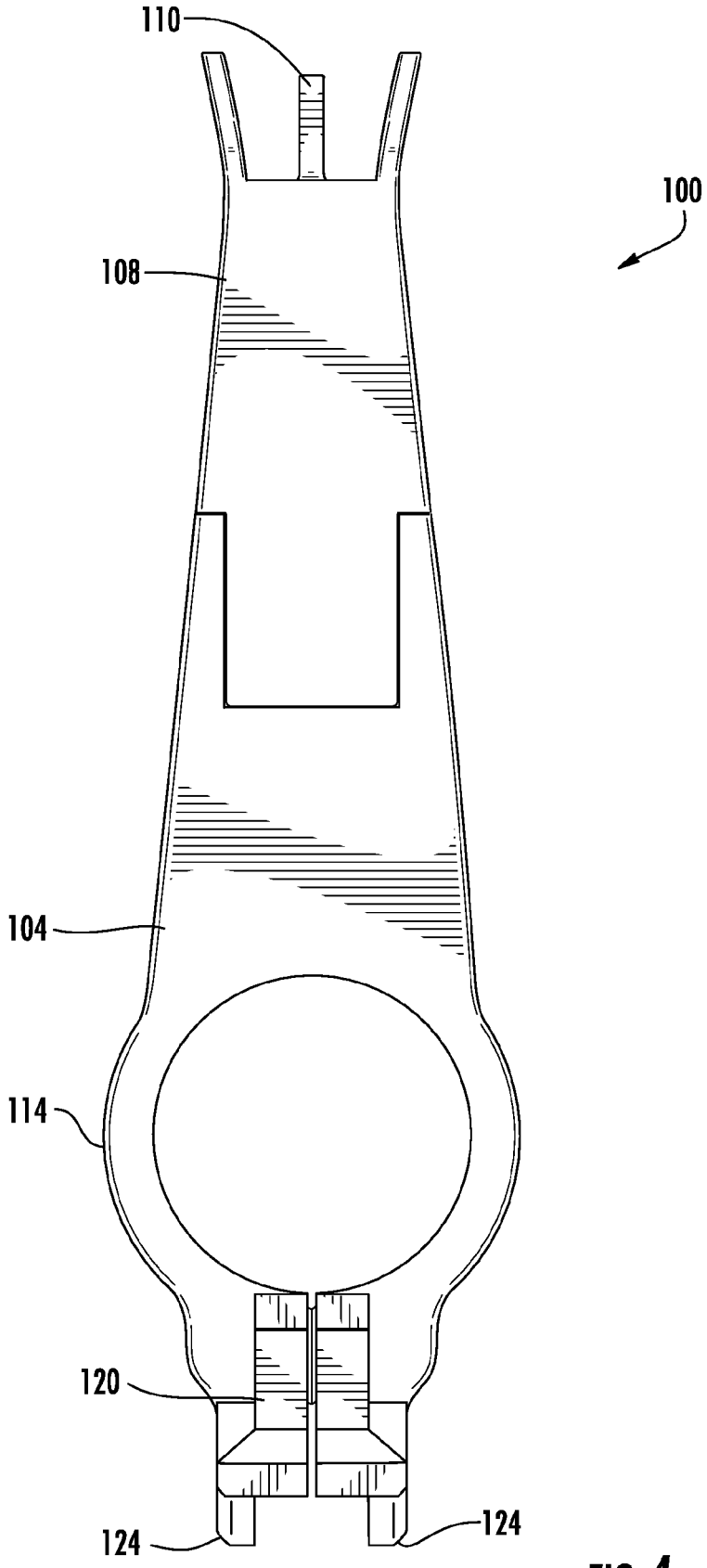
FIG. 4 is a front view thereof.
Figure 5:
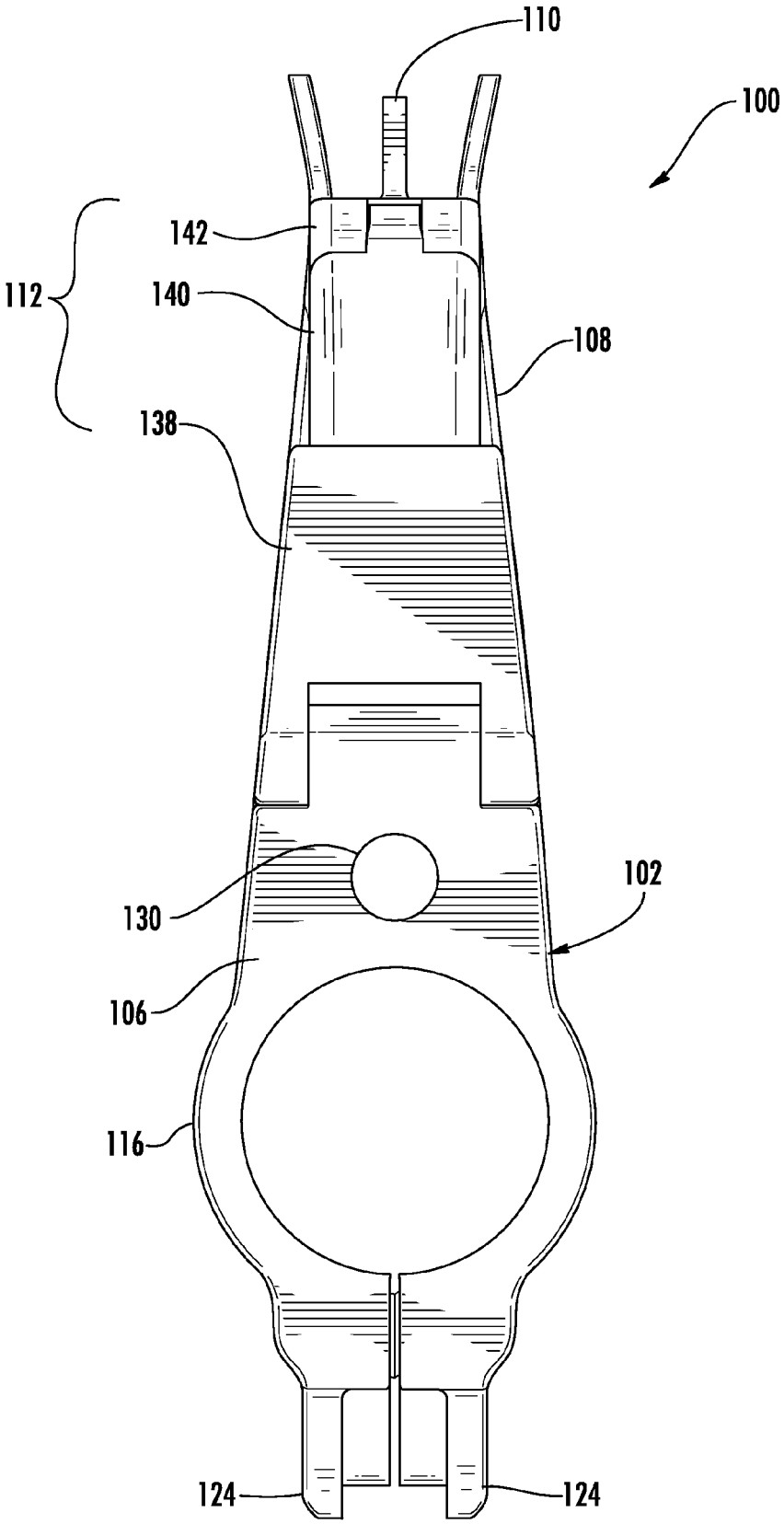
FIG. 5 is a rear view thereof.
Figure 6:
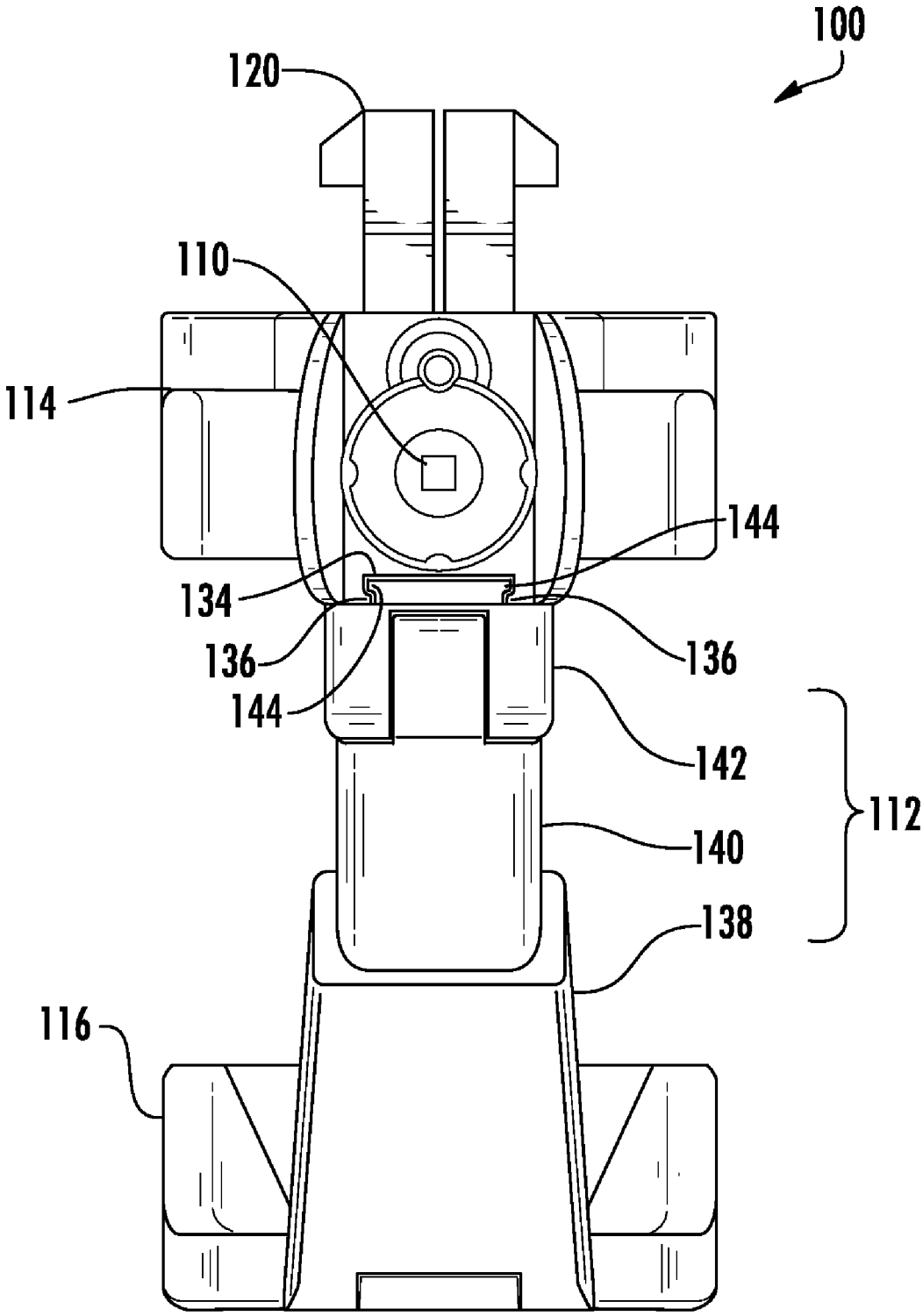
FIG. 6 is a top view thereof.
Figure 7:
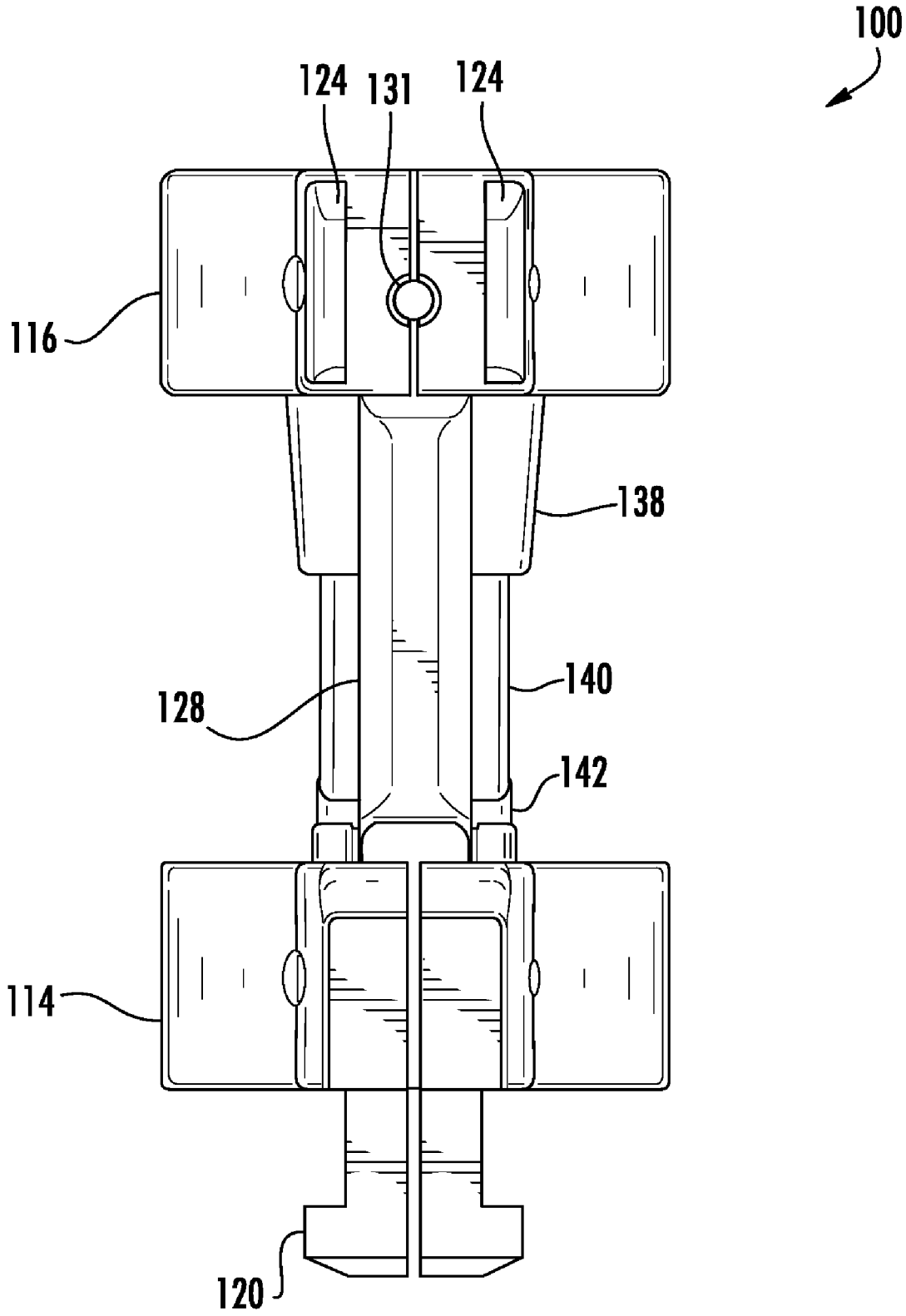
FIG. 7 is a bottom view thereof.

The slide arm assembly 112 includes a slide arm base 138, a spring 139 (best seen in FIG. 3B) received into the slide arm base 138, a slide arm 140 slidably received into the slide arm base 138 and engaging the spring, and a knuckle 142 pivotally attached to the slide arm 140. The knuckle 142 slidably engages the track on the forward sight frame 108 and a pair of opposing feet 144 engages each of the recesses formed by the raised lips 136 on the track, respectively. A set screw 146 prevents the knuckle 142 from coming free from the track. The bottom surface of the knuckle 142 includes a recess to receive a head of the set screw 146. One end of a slide arm 140 is pivotally connected to the knuckle 142 and the other end of the slide arm 140 is received in one end of a slide arm base 138. The spring 139 biases the slide arm 140 outwardly from the slide arm base 138. The other end of the slide arm base 138 is pivotally connected to the rear portion 106 of the base 102. As can be seen in FIG. 3A, the silhouette of the slide arm assembly 112, center member 128 and forward sight frame 108 form a unique triangle shape that has made the M-16 and AR-15 instantly recognizable.

A user can stow the folding sight 100 of the present invention by pressing down on the knuckle 142. As the knuckle 142 is pressed down it slides along the track on the forward sight frame 108. As a consequence, the slide arm 140 is compressed into the slide arm base 138, thereby compressing the spring 139 contained therein. Once the recess on the knuckle 142 contacts the head of the set screw 146, the forward sight frame 108 pivots downwardly towards the rear portion 106 of the base 102 until the forward sight frame 108 lies substantially flush against the slide arm assembly 112 and the slide arm assembly 112 lies substantially flush against the center member 128 of the base 102, as shown in FIG. 8.

The folding front sight 100 may be deployed by pivoting the forward sight frame 108 forwardly to its upright position. The spring 139 within the slide arm base 138 biases the slide arm 140 outwardly with sufficient force to provide a snap-action to the folding front sight 100.

In addition to the spring 139 contained in the slide arm assembly 112, spring-biased ball detents may be included in the forward sight frame 108. The spring biased ball detents are configured to selectively engage detents formed on the front portion 104 of the base 102. The spring-biased ball detents may be included to help keep the forward sight frame 108 from being unintentionally pivoted downwardly.

Figure 9:
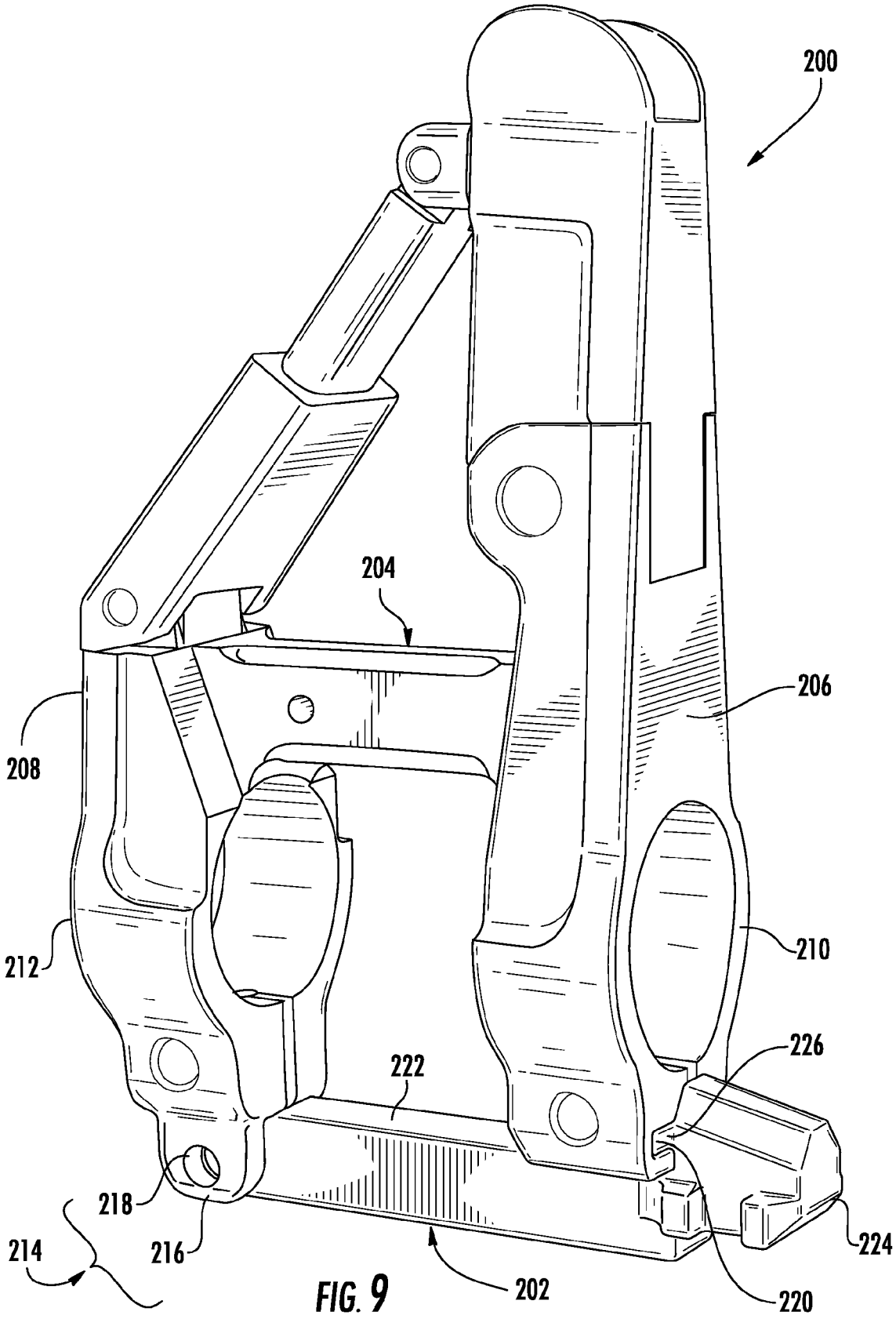
FIG. 9 is perspective view of an alternative embodiment of the folding front sight of the present invention that includes a removable bayonet lug.
Figure 10:
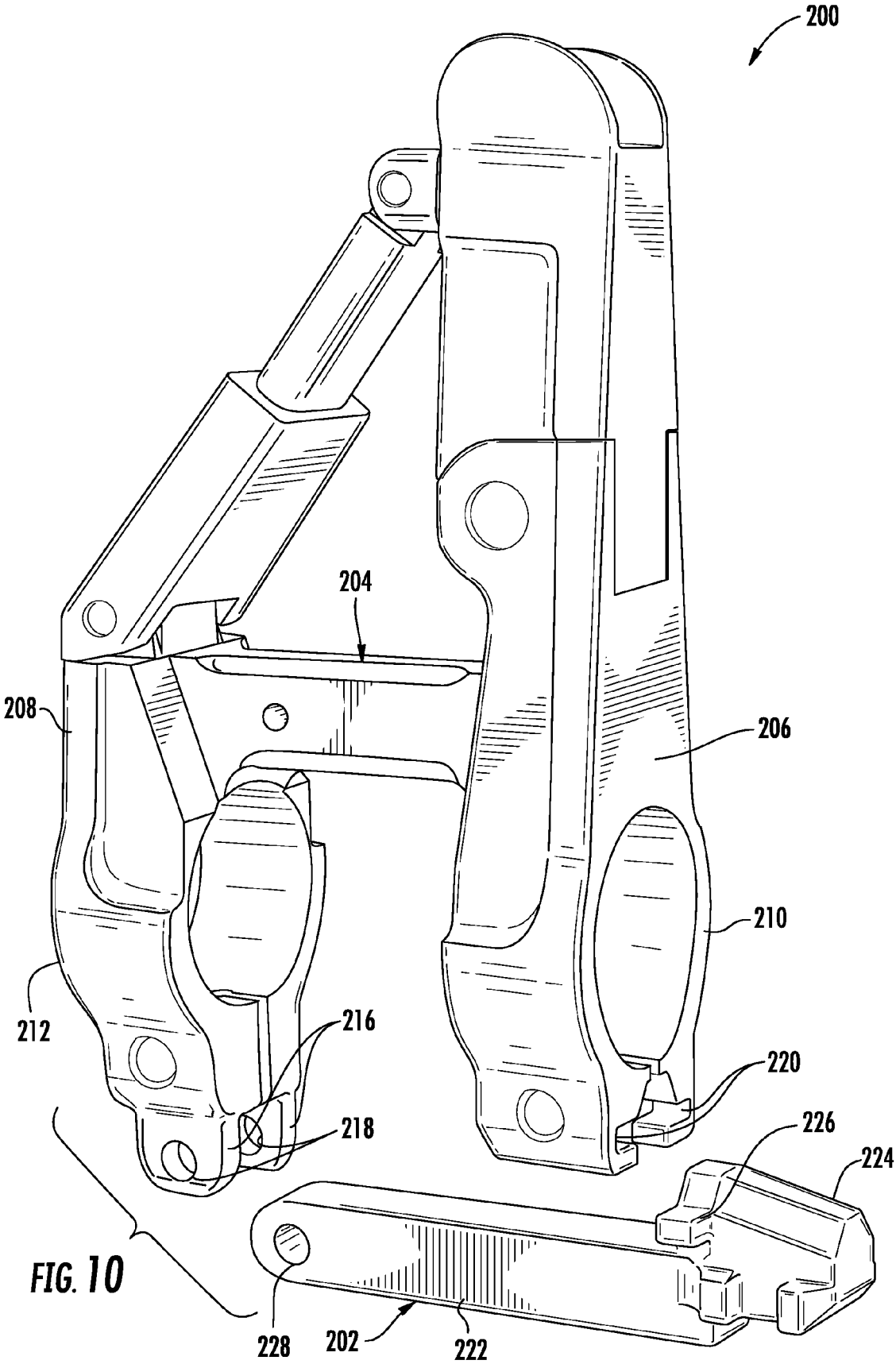
FIG. 10 is an exploded view of an alternative embodiment of the folding front sight of the present invention.

Referring now to FIGS. 9 and 10, an alternative embodiment of the folding front sight of the present invention is shown generally at 200, which includes a removable bayonet mounting structure 202. Like, the preferred embodiment 100, the alternative embodiment 200 includes a base portion 204 with a front portion 206 and a rear portion 208. A pair of clamps 210, 212 depends from front and rear portions 206, 208 the base portion 204, respectively. The rearward most clamp 212 includes a sling swivel mounting structure 214, including a pair of opposing tabs 216 with through holes 218. The forward most clamp 210, however, lacks an integral bayonet lug. Instead the forward most clamp 210 includes a pair of opposing slots 220 configured to receive the bayonet mounting structure 202, which will be further described below.

The bayonet mounting structure 202 includes a center member 222 having a front end and a rear end. A bayonet lug 224 extends from the front end. The bayonet lug 224 is configured to receive and retain a bayonet, such as a standard USGI M7 Bayonet, to the barrel of the weapon. The bayonet lug 224 also includes a pair of laterally extending support tabs 226, which are configured to slide into slots 220 on the forward most clamp 210.

The rear end of the center member 222 includes a through hole 228 configured to align with and be secured to the sling swivel mounting structure 214. It is important to note that the in this embodiment a sling swivel may not be mounted to the sling swivel mounting structure 214 at the same time as the bayonet mounting structure 202.

The alternative embodiment may include some or all the features described above for the preferred embodiment.

Therefore, it can be seen that the present invention provides a unique solution to the problem of providing a folding front sight that mimics that appearance of a standard front sight.

It would be appreciated by those skilled in the art that various changes and modifications can be made to the illustrated embodiments without departing from the spirit of the present invention. All such modifications and changes are intended to be within the scope of the present invention.

I claim:

1. A folding front sight for a firearm, comprising:

a base having a forward end and a rearward end;

a forward sight frame at the forward end of the base, said forward sight frame including a front sight post at an upper end thereof, and being movable between a vertical, upright deployed position, and a stowed position;

a support member having a rear end extending from the rearward end of the base and a forward end engaged with the upper end of the forward sight frame to support said forward sight frame when said forward sight frame is in said deployed position; and said base, said forward sight frame and said support member cooperating to define a triangular silhouette when said forward sight frame is in said deployed position.

2. The article of claim 1, wherein said base includes a clamp configured and arranged for securing said base to a barrel of a firearm.

3. The article of claim 2, further comprising a bayonet lug extending from said clamp.

4. The article of claim 2, further comprising a sling swivel mounting structure depending from said clamp.

5. The article of claim 1, wherein said forward sight frame is pivotably mounted to said forward end of said base, and is pivotably movable from a vertical, upright deployed position to a stowed position.

6. The article of claim 1, wherein said support member is pivotably mounted to said rearward end of said base, and is pivotably movable from a deployed position to a stowed position.

7. The article of claim 1, wherein the support member further comprises:

an arm base pivotally connected to the rear portion of said base;

said arm base having a surface defining a slot holding a spring therein;

a slide arm received within the slot and against the spring, the spring urging the slide arm outwardly from the slot of the arm base; and a knuckle pivotally connected to the slide arm and slidably engaged with said forward sight frame.

8. The article of claim 1, further comprising:

a first clamp depending from the forward portion of the base member; and a second clamp depending from the rearward portion of the base member;

said first clamp and said second clamp configured and arranged to attach to the barrel of a firearm.

9. The article of claim 8, further comprising a sling swivel mounting structure depending from the second clamp.

10. The article of claim 8, further comprising a bayonet lug extending from the first clamp.

11. The article of claim 8, further comprising a bayonet mounting structure suspended between the first clamp and the second clamp, the bayonet mounting structure including a bayonet lug.

12. The article of claim 11, wherein the bayonet mounting structure is removably secured between the first clamp and the second clamp.

13. The article of claim 1, wherein the front sight post is upwardly and downwardly adjustable.

14. The article of claim 1, further comprising a surface defining a hole into the base member configured to receive a gas tube of a gas operated firearm.

15. A folding front sight for a firearm, comprising:

a base having a forward end and a rearward end;

a forward sight frame at the forward end of the base, said forward sight frame including a front sight post at an upper end thereof, and being movable between an upright deployed position, and a stowed position;

a support member including an arm base pivotally connected to the rear portion of said base, said arm base having a surface defining a slot holding a spring therein, a slide arm received within the slot and against the spring, the spring urging the slide arm outwardly from the slot of the arm base, a knuckle pivotally connected to the slide arm and slidably engaged with said forward sight frame; and said base, said forward sight frame and said support member cooperating to define a triangular silhouette when said forward sight frame is in said deployed position.

16. The article of claim 15, wherein said base includes a clamp configured and arranged for securing said base to a barrel of a firearm.

17. The article of claim 16, further comprising a bayonet lug extending from said clamp.

18. The article of claim 16, further comprising a sling swivel mounting structure depending from said clamp.

19. The article of claim 15, further comprising:

a first clamp depending from the forward portion of the base member; and a second clamp depending from the rearward portion of the base member;

said first clamp and said second clamp configured and arranged to attach to the barrel of a firearm.

20. The article of claim 19, further comprising a sling swivel mounting structure depending from the second clamp.

21. The article of claim 19, further comprising a bayonet lug extending from the first clamp.

22. The article of claim 19, further comprising a bayonet mounting structure suspended between the first clamp and the second clamp, the bayonet mounting structure including a bayonet lug.

23. A folding front sight for a firearm, comprising:

a base having a forward end and a rearward end;

a forward sight frame at the forward end of the base, said forward sight frame including a front sight post at an upper end thereof, and being movable between an upright deployed position, and a stowed position;

a support member having a rear end extending from the rearward end of the base and a forward end engaged with the upper end of the forward sight frame to support said forward sight frame when said forward sight frame is in said deployed position and collapsing down forwardly when said forward sight frame is in said stowed position; and said base, said forward sight frame and said support member cooperating to define a triangular silhouette when said forward sight frame is in said deployed position.

* * * * *